United States Patent [19]

Sakai et al.

[11] Patent Number: 4,761,359

[45] Date of Patent: Aug. 2, 1988

[54] ELECTROPHOTOGRAPHIC PROCESS USING PHOTOCONDUCTIVE CYLINDER OF SMALL DIAMETER

[75] Inventors: Kiyoshi Sakai, Chofu; Naoto Fujimura, Yokohama; Junichi Kishi, Tokyo; Teigo Sakakibara, Yokohama, all of Japan

[73] Assignee: Canon Kabushiki Kaisha, Tokyo, Japan

[21] Appl. No.: 912,124

[22] Filed: Sep. 29, 1986

[30] Foreign Application Priority Data

Sep. 30, 1985 [JP] Japan ..... 60-214698

[51] Int. Cl.[4] ..... G03G 13/22

[52] U.S. Cl. ..... 430/126; 430/31

[58] Field of Search ..... 430/31, 126

[56] References Cited

U.S. PATENT DOCUMENTS 4,591,258 5/1986 Nishino et al. ..... 355/3 R

*Primary Examiner*—Roland E. Martin

*Attorney, Agent, or Firm*—Fitzpatrick, Cella, Harper & Scinto

[57] ABSTRACT

There is disclosed an electrophotographic process adapted for using a cylindrical photosensitive member of a small diameter of 40 mm or less which has such a charging characteristic that when it is charged to 700 V (or −700 V) and then exposed to such an intensity of light as to provide a potential of 200 V (or −200 V) after exposure for 50 msec., the photosensitive member will have a potential of 20 to 150 V (or −20 to −150 V) after exposure for 150 msec. In the process, the steps of charging, exposure, developing and transfer involved, and the following relationship is satisfied: $R\theta/v \geqq 0.30$, wherein R (mm) is the outer diameter of the cylindrical photosensitive member, $\theta$ (radian) is the angle formed between the exposure and the developing position on the cylindrical photosensitive member with respect to the center thereof as the angle center, and v (mm/sec) is the circumferential speed of the cylindrical photosensitive member. By the process, undesirable increase in residual potential on the photosensitive member to solve the problems of increasing image density and fog during successive copying.

9 Claims, 1 Drawing Sheet

ELECTROPHOTOGRAPHIC PROCESS USING PHOTOCONDUCTIVE CYLINDER OF SMALL DIAMETER

FIELD OF THE INVENTION AND RELATED ART

This invention relates to an electrophotographic process, particularly an electrophotographic process when a small-diameter cylindrical photosensitive member is used.

Photosensitive members which have heretofore been used in electrophotographic devices are shaped in sheets or cylinders, and cylindrical photosensitive members practically used have outer diameters of 60 mm or more. However, in recent years, with compaction of electrophotographic apparatus and development of process kits in which charging, developing and cleaning members, etc., are integrated (see Japanese Laid-Open Patent Applications Nos. 21261/1983, 108553/1983, 198052/1983, etc.), cylindrical photosensitive members with a small diameter have been demanded. However, when a cylindrical photosensitive member with a small diameter is used, since the number of rotations of this photosensitive member required for obtaining one sheet of copy becomes extremely large, there ensued a problem that the residual potential on the photosensitive member became elevated during repeated use, thus involving a drawback that image density and fog of white ground became increasingly higher.

SUMMARY OF THE INVENTION

A principal object of the present invention is to provide an electrophotographic process which can remove the drawbacks of the prior art as described above and at the same time produce an image of high quality, and further can improve the durability of the photosensitive member.

More specifically, according to the present invention, there is provided an electrophotographic process, wherein a cylindrical member having an outer diameter of 25 mm to 40 mm is used, the photosensitive member having such a charging characteristic that when it is charged to 700 V (or −700 V) and then exposed to such an intensity of light as to provide a potential of 200 V (or −200 V) after exposure for 50 msec, the photosensitive member will have a potential of 20 to 150 V (or −20 to −150 V) after exposure for 150 msec, the electrophotographic process comprising at least the steps of charging, exposure, developing and transfer, and satisfying the following inequality:

$$\frac{R\theta}{v} \geqq 0.30,$$

wherein R (mm) is the outer diameter of the cylindrical photosensitive member, $\theta$ (radian) is the angle formed between the exposure and the developing position on the cylindrical photosensitive member with respect to the center thereof as the angle center, and v (mm/sec) is the circumferential speed of the cylindrical photosensitive member. Also, the present invention provides an electrophotographic process having a specific feature in that the above cylindrical photosensitive member comprises amorphous-Si. Also, the present invention provides an electrophotographic process having a specific feature in that the above cylindrical photosensitive member comprises a function-separation type photosensitive member. Also, the present invention provides an electrophotographic process having a specific feature in that the above cylindrical photosensitive member comprises a function-separation type organic photosensitive member. Also, the present invention provides an electrophotographic process having a specific feature in that the above cylindrical photosensitive member is assembled in a process kit.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

As the laminar structure of the function separation type photosensitive member to be used in the present invention, various kinds of structures may be included as shown below:

(1) one of the function separation type in which a charge transportation layer (CTL) is provided on a charge generation layer (CGL);

(2) one of the charge separation type in which a CGL is provided on a CTL;

(3) the structure of (1) or (2) in which at least one intermediate layer (having a function of a barrier layer, an adhesive layer, etc.) is provided between the CTL and CGL layers;

(4) the structure of (1) or (2) having a protective layer or an insulating layer as the uppermost layer; and (5) the structure of (1) or (2) containing a charge-transfer (CT) substance also in the CGL.

According to the present invention, a function separation-type organic photoconductive member, having a problem that residual potential is elevated because the carriers generated cannot be sufficiently migrated through the charge transportation layer, is particularly effectively applicable for an electrophotographic process used for a cylindrical photosensitive member with a small diameter.

The charge generation substance to be used in the present invention may include, for example, selenium-tellurium, pyrylium, a phthalocyanine type pigment, an anthanthrone pigment, a dibenzpyrenequinone pigment, an azo pigment, an indigo pigment, a quinacridone type pigment, quinocyanine, an asymmetric quinocyanine, etc. Particularly, azo pigments and phthalocyanine pigments are preferred. On the other hand, the charge transportation substance to be used in the present invention may include, for example, a hydrazone compound, a stilbene type compound, a carbazole compound, a pyrazoline compound, an oxazole compound, a thiazole compound, a fluorenone compound, a triarylmethane compound, etc. Particularly, hydrazone compounds are preferred.

The small diameter cylindrical photosensitive member to be used in the electrophotographic process of the present invention may also comprise a-Si (amorphous silicon).

Figure 1:
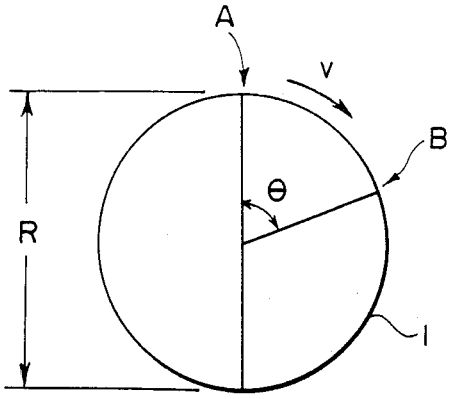
FIG. 1 schematically illustrates the relationship of the outer diameter, the circumferential speed of a cylindrical photosensitive member, and the angle between the exposure position and the developing position.

As contrasted to a cylindrical photosensitive member with a greater outer diameter of the prior art, a cylindrical photosensitive member 1 (FIGS. 1 and 2) with a small diameter R, particularly an outer diameter of 40 mm or less, more specifically 25–40 mm, involves a specific problem, when the photosensitive member has such a charging or photoelectric characteristic that when it is charged to 700 V (or −700 V) and then exposed to such an intensity of light as to provide a potential of 200 V (or −200 V) 50 msec after the exposure, the photosensitive member will have a potential of 20 to 150 V (or −20 to −150 V) 150 msec after the exposure, and the cylindrical photosensitive member is used in an electrophotographic apparatus whereby electrophotographic steps including at least charging, exposure, development and transfer. More specifically, in such a case, the time required for the cylindrical photosensitive member 1 to travel from the exposure position A to the development position B (FIG. 1) becomes short, so that before carriers generated by the exposure complete the migration through the photosensitive member, the cylindrical photosensitive member will proceed to the subsequent development step, etc. For this reason, there has been involved a problem that residual potential on the photosensitive member is accumulated to make the image density increasingly higher or cause the white ground portion to be blackened (so-called fog). However, by making $R\theta/v$ (see FIG. 1, R is the outer diameter (mm) of the cylindrical photosensitive member 1, $\theta$ (radian) is the angle between the exposure position and the developing position with the center of the cylindrical photosensitive member as the angle center and v (mm/sec) is the circumferential speed of the cylindrical photosensitive member) 0.30 or more as in the present invention, the photosensitive member can proceed to a step such as transfer, charging, etc., for the first time after the carriers generated by the exposure have sufficiently migrated through the photosensitive member to complete the migration. Accordingly, no accumulation of residual potential occurs on the photosensitive member even when used repeatedly, thus causing no change in image density or phenomenon of blackening of the white ground portion, whereby uniform images of good quality can be obtained stably.

Also, in the step of removing the residual toner on the photosensitive member by blade cleaning, the cleaning characteristic can be also effectively improved by making $R\theta/v$ 0.30 or more.

The electrophotographic process of the present invention can be particularly effectively applied to a process kit for which a cylindrical photosensitive member with a small diameter is demanded to be used.

The present invention is described in more detail by referring to Examples.

EXAMPLE 1

A photosensitive member was prepared by successively laminating an adhesive layer, a charge generation layer and a charge transportation layer as shown below on an aluminum cylinder having an outer diameter of 30 mm and an inner diameter of 28 mm.

For the adhesive layer, an aqueous ammonia solution of casein (casein 11.2 g, 28% aqueous ammonia solution 1 g, water 222 ml) was coated according to the dip coating method and dried to form a primer or adhesive layer at a coating rate of 1.0 g/m$^2$.

For the charge generation layer, 1 part by weight of a charge generation substance shown by the following formula (I):

(I)

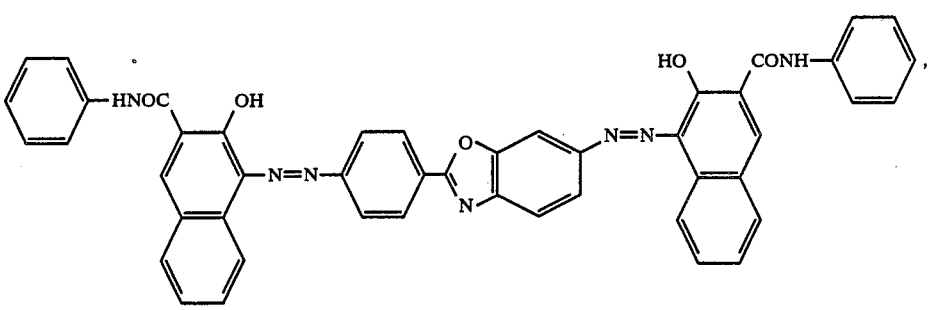

1 part by weight of a butyral resin (S-LEC BM-2: produced by Sekisui Kagaku K.K.) and 30 parts by weight of isopropyl alcohol, were dispersed by means of a ball mill for 4 hours. This dispersion was coated on the adhesive layer previously formed according to the dip coating method and dried to form a charge generation layer. The coating thickness was 0.30 μm.

Next, for the charge transportation layer, 1 part by weight of a charge generation substance shown by the formula (II):

(II)

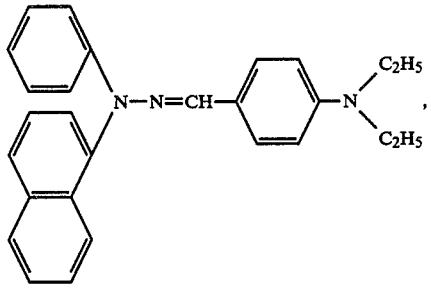

1 part by weight of a polysulfone resin (P1700: produced by Union Carbide Corp.) and 6 parts by weight of monochlorobenzene were mixed and dissolved under stirring by means of a stirrer. This solution was coated on the charge generation layer according to the dip coating method and dried to form a charge transportation layer. The coating thickness was 12 μm.

Next, the photosensitive member prepared according to the above method was subjected to a successive copying test for 12 hours, wherein the photosensitive member was first charged to −700 V, the time from exposure to developing was set to 150 msec ($R\theta/v=0.30$, $\theta=1.1$ radian) and the charging position was placed 0.6 radian upstream from the exposure position. As a result, copying was found to be very stable, and the residual potential increased by only 25 V in terms of the absolute value (from −95 V at the initial stage to −120 V after the successive copying test). There was also no increase in image density, but uniform images similarly as in the initial stage could be obtained. Incidentally, the photosensitive member showed a potential of −80 V after 150 msec-exposure to an intensity of light providing −200 V after 50 msec-exposure.

COMPARATIVE EXAMPLE 1

Example 1 was repeated under all the same conditions except that the time from exposure to developing was changed to 110 msec ($R\theta/v=0.22$), whereby the residual potential increased by 80 V in terms of the absolute value (from −95 V at the initial stage to −175 V after the successive copying test), the image density also increased to generate a phenomenon that the white ground portion became black and no good images could be obtained after the successive copying.

COMPARATIVE EXAMPLE 2

When an aluminum cylinder with an outer diameter of 60 mm was used in Comparative Example 1, the residual potential was 10 V. Since the outer diameter was twice that of Comparative Example 1 and the ratio $V/\theta$ was maintained, the value $R\theta/V=2\times0.22=0.44$.

This Example shows that the residual potential does not substantially increase where a photosensitive member is selected having a large diameter beyond the scope of the present invention.

COMPARATIVE EXAMPLE 3

Example 1 was repeated except for using a selenium photosensitive member prepared by forming an about 50 μm-thick selenium film by vacuum evaporation on the aluminum cylinder as used in Example 1 and changing the time from exposure to developing to 180 msec ($R\theta/v=0.36$).

The residual potential increased by only 10 V (from −15 V at the initial stage to −25 V). However, the potential before exposure which was −700 V at the initial stage also decreased to −450 V after the successive copying test, whereby the image density remarkably decreased and good images could not be obtained after the successive copying test. Incidentally, the photosensitive member showed a potential of −10 V after the 150 msec-exposure.

COMPARATIVE EXAMPLE 4

A zinc oxide photosensitive member was prepared in the following manner. First, 35 g of acrylic resin was dissolved in 150 g of toluene, and 100 g of zinc oxide was added thereto to prepare a zinc oxide resin-solution. Then, a solution of 100 mg of Rose Bengal dissolved in 10 g of methanol was added to the above zinc oxide resin solution, and the resultant mixture was subjected to dispersion by means of a ball mill for 24 hours to prepare a zinc oxide resin dispersion. The dispersion was applied by dipping onto the aluminum cylinder already provided with the primer layer to prepare the zinc oxide photosensitive member having a 40 μm-thick coating.

Example 1 was repeated except for using the zinc oxide photosensitive member and changing the time from exposure to developing to 20 msec ($R\theta/v=0.40$).

The residual potential increased during the successive copying test by 110 V (from −160 V at the initial stage to −270 V), whereby the image density increased and blackening of the white ground occurred. Thus, good images could not be obtained after the successive copying test. The photosensitive member showed a potential of −155 V after the 150 msec-exposure.

EXAMPLE 2

A photosensitive member was prepared by forming an a-Si layer having a film thickness of 30 μm on an aluminum cylinder having an outer diameter of 25 mm and an inner diameter of 20 mm.

Next, the photosensitive member prepared according to the above method was subjected to a successive copying test with a time from exposure to development of 150 msec ($R\theta/v=0.30$, $\theta=1.2$ radian) for 70 hours. As a result, copying was very stable, and the residual potential increased by only 5 V (from −30 V to −35 V). There was also no increase in image density and uniform images could be obtained similarly as in the initial stage. The photosensitive member showed a potential of −20 V after the 150 msec-exposure.

COMPARATIVE EXAMPLE 5

When Example 2 was repeated under all the same conditions except that the time from exposure to developing was changed to 90 msec ($R\theta/v=0.18$), the residual potential increased by 70 V, the image density also increased to generate the phenomenon that the white ground portion became black and no good image could be obtained after the successive copying.

EXAMPLE 3

A photosensitive member was prepared by successively laminating an adhesive layer, a charge generation layer and a charge transportation layer on an aluminum cylinder having an outer diameter of 40 mm and an inner diameter of 38 mm.

For the adhesive layer, an aqueous ammonia solution of casein (casein 11.2 g, 28% aqueous ammonia solution 1 g, water 222 ml) was coated according to the dip coating method and dried to form a primer layer of a coating rate of 1.0 g/m$^2$.

For the charge generation layer, 1 part by weight of the charge generation substance shown by the above mentioned formula (I), 1 part by weight of a butyral resin (S-LEC BM-2: produced by Sekisui Kagaku K.K.) and 30 parts by weight of isopropyl alcohol were dispersed by means of a ball mill for 4 hours. This dispersion was coated on the adhesive layer previously formed according to the dip coating method and dried to form a charge generation layer. The film thickness was 0.25 μm.

Next, for the charge transport layer, 1 part by weight of the charge generation material shown by the above mentioned formula (II), 1 part by weight of a polysulfone resin (P1700: produced by Union Carbide Corp.) and 6 parts by weight of monochlorobenzene were mixed and dissolved under stirring by means of a stirring machine. This solution was coated on the charge generation layer according to the dip coating method and dried to form a charge transport layer. The film thickness was 18 μm.

Figure 2:
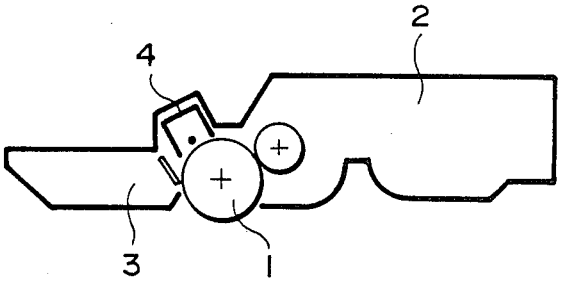
FIG. 2 is a longitudinal sectional view of a process kit to which the electrophotographic process of the present invention is applied.

Next, the photosensitive member prepared according to the above method was assembled in a process kit having a primary charger 4, a developing means 2 and a cleaner 3 arranged integrally in the rotational direction of the photosensitive member around the cylindrical photosensitive member 1 as shown in FIG. 2, and subjected to a successive copying test with a time from exposure to developing of 200 msec ($R\theta/v=0.40$, $\theta=1.0$ radian) for 30 hours. As a result, copying was very stable and the residual potential increased by only 5 V (from −95 V to −100 V). There was also no elevation in image density and uniform images could be obtained similarly as in the initial stage. The photosensitive member showed a potential of −85 V after the 150 msec-exposure.

COMPARATIVE EXAMPLE 6

Example 3 was repeated under all the same conditions except that the time from exposure to developing was changed to 130 msec ($R\theta/v=0.26$), whereby the residual potential increased by 65 V, the image density also increased to generate the phenomenon that the white ground portion became black and no good images could be obtained after the successive copying.

EXAMPLE 4

A photosensitive member was prepared by successively laminating an adhesive layer, a charge generation layer and a charge transportation layer as shown below on an aluminum cylinder having an outer diameter of 30 mm and an inner diameter of 28 mm.

For the adhesive layer, an aqueous ammonia solution of casein (casein 11.2 g, 28% aqueous ammonia solution 1 g, water 222 ml) was coated according to the dip coating method and dried to form a primer layer at a coating rate of 1.0 g/m$^2$.

Next, for the charge transport layer, 1 part by weight of a charge transport material shown by the formula (III):

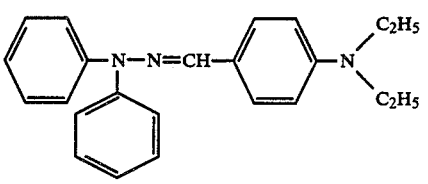

(III)

and 1 part by weight of polymethyl methacrylate (number-average molecular weight: 100,000) were dissolved in 11 parts by weight of benzene, and the solution was coated on the adhesive layer according to the dip coating method to a film thickness after drying of 14 μm and dried to form a charge transportation layer.

Next, to a solution of 5 g of polymethyl methacrylate (number-average molecular weight 100,000) dissolved in 800 ml of chlorobenzene were added 5 g of tetrafluoroethylene resin (Daikin-Polyflon TFE Low-Polymer, produced by Daikin Kogyo K.K.) and 10 g of the following disazo pigment:

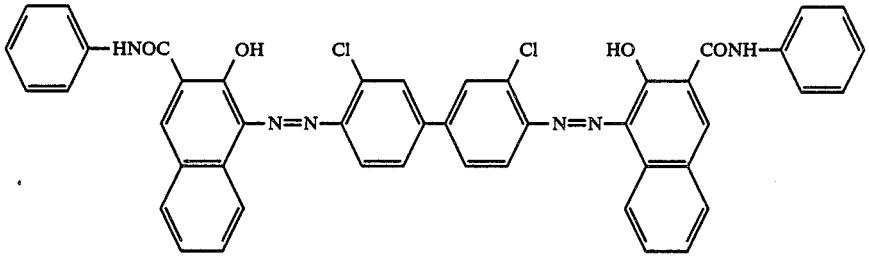

The mixture was dispersed in a sand mill for 10 hours. The dispersion was coated according to the dip method on the charge transportation layer previously formed and dried to form a charge generation layer with a thickness of 5 μ. Thus an electrophotographic photosensitive member was prepared.

Next, the photosensitive member prepared according to the above method was subjected to a successive copying test by positive charging for 10 hours, wherein the photosensitive member was first charged to +700 V, and the time from exposure to developing was set to 160 msec ($R\theta/v=0.32$). As a result, copying was very stable and the residual potential change increased by only 15 V (from +120 V to +135 V). There was also no increase in image density and uniform images could be obtained similarly as in the initial stage. The photosensitive member showed a potential of 105 V after the 150 msec exposure.

COMPARATIVE EXAMPLE 7

Example 1 was repeated under all the same conditions except that the time from exposure to developing was changed to 90 msec ($R\theta/v=0.18$), whereby the residual potential increased by 40 V, the image density also increased to generate the phenomenon that the white ground portion became black and no good images could be obtained after the successive copying.

What is claimed is:

1. In an electrophotographic process employing the steps of charging, exposing, developing and transferring, which employs a cylindrical photosensitive member having an outer diameter (R) from about 25 to 40 millimeters and subject to formation of elevated residual potential thereon during repeated use, the improvement which comprises:

(a) adjusting the charging characteristic of the cylindrical photosensitive member so that upon charging said cylindrical photosensitive member to ±700 volts and exposing said cylindrical photosensitive member to a light intensity sufficient to provide a potential of ±200 volts after exposure for 50 msec, a potential of ±20 to ±150 volts after exposure for 150 msec is obtained; and (b) selecting a value for angle $\theta$ (in radians) formed between an exposing and a developing position on said cylindrical photosensitive member with respect to the center thereof as the angle center, and a value for the circumferential speed (v) in mm/sec of said cylindrical photosensitive member to satisfy the equation:

$R\theta/V \geqq 0.3$.

2. An electrophotographic process according to claim 1, wherein the cylindrical photosensitive member comprises an organic photoconductive member.

3. An electrophotographic process according to claim 1, wherein the cylindrical photosensitive member comprises amorphous silicon.

4. An electrophotographic process according to claim 1, wherein the cylindrical photosensitive member comprises a function-separation type photoconductive member.

5. An electrophotographic process according to claim 1, wherein the cylindrical photosensitive member comprises a function-separation type organic photoconductive member.

6. An electrophotographic process according to claim 1 wherein the cylindrical photosensitive member is assembled in a process kit including at least a charging means, a developing means and a cleaning means integrated with the cylindrical photosensitive member as a unit and said unit capable of being detachably mounted in an electrophotographic apparatus.

7. An electrophotographic process according to claim 1, wherein the charge generation substance contained in the cylindrical photosensitive member is a substance selected from the group consisting of selenium-tellurium, pyrylium, a phthalocyanine type pigment, an anthanthrone pigment, a dibenzpyrenequinone pigment, an azo pigment, an indigo pigment, a quinacridone type pigment, an asymmetric quinocyanine, and quinocyanine.

8. An electrophotographic process according to claim 1, wherein the charge transportation substance contained in the cylindrical photosensitive member is a substance selected from the group consisting of a hydrazone compound, a stilbene compound, a carbazole compound, a pyrazoline compound, an oxazole compound, a thiazole compound, a fluorenone compound, and a triarylmethane type compound.

9. An electrophotographic process according to claim 1, wherein the charge generation substance contained in the cylindrical photosensitive member is an azo pigment and the charged transportation substance is a hydrazone compound.

* * * * *